US005564894A

United States Patent [19]

Moncrief et al.

[11] Patent Number: 5,564,894

[45] Date of Patent: Oct. 15, 1996

[54] ARTICLE SELECTION AND DELIVERY METHOD AND APPARATUS

[75] Inventors: Frank Moncrief, Acworth; John P. Arena, Marietta, both of Ga.

[73] Assignee: Riverwood International Corporation, Atlanta, Ga.

[21] Appl. No.: 418,101

[22] Filed: Apr. 6, 1995

[51] Int. Cl.[6] ..... B65G 59/08

[52] U.S. Cl. ..... 414/798.9; 414/797; 414/737; 271/5; 271/91; 271/93

[58] Field of Search ..... 414/733, 737, 414/738, 793, 797, 798.9, 789.5; 271/5, 91, 93

[56] References Cited

U.S. PATENT DOCUMENTS

| | | | |
|---|---|---|---|
| 4,720,227 | 1/1988 | Eberle | 271/93 |
| 4,806,071 | 2/1989 | Sartorio | 271/91 |
| 5,029,836 | 7/1991 | Swaneck | 414/737 |
| 5,048,811 | 9/1991 | Hochbein | 271/5 |
| 5,244,343 | 9/1993 | Lockert | 414/797 |

*Primary Examiner*—Karen Merritt
*Assistant Examiner*—Douglas Hess
*Attorney, Agent, or Firm*—Hopkins & Thomas

[57] ABSTRACT

A partition inserter has a vacuum assembly which pivots out to contact an end partition in a stack, pivots back to remove the partition, and then moves downwardly to release the partition. The positioning of the vacuum assembly is controlled by a set of cams and a cam follower for controlling the horizontal position of the vacuum assembly and a third cam and cam follower for controlling the vertical position of the vacuum assembly. The vacuum assembly has an upper set of cups which move down with the assembly to lower the partition. The upper vacuum cups are also adjustably mounted to the assembly so that the same assembly may be used for partitions of various sizes. When the partition is released from the vacuum cups, the partition is guided downwardly by a pair of conveyors to a set of shooter wheels. The conveyor and shooter wheels are mounted to a set of plates which are adjustably mounted to the frame of the apparatus. The distance between the conveyors and shooter wheels can be adjusted to equal the width of the partition.

24 Claims, 7 Drawing Sheets

ARTICLE SELECTION AND DELIVERY METHOD AND APPARATUS

FIELD OF THE INVENTION

This invention relates to a method and apparatus for selecting an article from a group of articles, and delivering the article to a desired location. The invention is particularly suited for use in packaging machines that insert planar partitions into preconfigured product groups. More specifically, this invention can be used for selecting a planar partition, such as a paperboard card, from a supply magazine, and delivering the partition to a specific location within the preconfigured product group. The invention includes elements which permit the delivering of the partition to the location at a specific time, in relation to the continuous movement of product groups below the selection and delivery apparatus.

BACKGROUND OF THE INVENTION

Automated, continuous-motion systems for handling products often require an apparatus to select an article from an article supply magazine, and deliver the article to a predetermined location. Often such an article delivery process must be accomplished in timed relationship with other functions of the automated machinery. A specific example of this relates to packaging machines used for the selection, grouping and packaging of products, such as beverage containers, into a carton or carrier. In such devices, products, such as beverages bottles, are fed onto a conveyor which directs the bottles to various work stations of the packaging machine. The bottles are selected from an infeed area, grouped according to a desired number, configured as a group into a predetermined configuration and finally inserted into a bottle carrier, such as an open, paperboard carton. Prior to the step of inserting the bottles into the carton, partitions often are required to be inserted between the bottles, to assist in preventing breakage.

While in the past, some bottle carriers have included integrally mounted partitions, other types of carriers without integrally mounted partitions have required separate partitions to be inserted into the configured bottle group. Additionally, while some packaging machines may interrupt the forward movement of the bottle group through the machine to perform a step, such as the insertion of a partition, most automated packaging machines, such as continuous motion, high capacity devices, do not interrupt product flow. All tasks to be performed on or with the product must be performed while the product is moving through the machine, often at high rates of speed. Other uses for such article selection and delivery devices include those used to insert informational literature, coupons, or advertisements into a product container.

Regarding packaging machines, however, devices for inserting partitions into bottle groups are known. Such devices include a supply magazine into which the partitions are held, and an apparatus for selecting a single partition at a time from the magazine and delivering the partition to a preselected location within the bottle group at a specific point of time as the bottle group passes, usually below, the partition inserter.

A known partition selection and delivery apparatus includes a partition supply magazine which presents a group of stacked partitions from which single partitions are to be selected in order. A selection device is disposed adjacent to the front of the magazine, and includes a line of vacuum cups that are moved forwardly to engage the first partition in the magazine. The vacuum cups are biased forwardly to engage the lower portion of the first partition on the supply magazine. The vacuum applied by the vacuum cup releasably engages the partition to the vacuum cups. The vacuum cups are then biased away from the supply magazine, pulling a single partition from the magazine. A segmented wheel is rotated toward the partition so that the segment pushes the partition against a friction wheel. Together the segmented wheel and the friction wheel pull the partition to a location in preparation for the partition to be inserted into the bottle group.

One major drawback with this known arrangement using a segmented wheel is that the partition is pulled from its orientation in the supply magazine, then rotated or turned as it is pulled through the apparatus with the segmented wheel and the friction wheel. The partition is then again rotated so as to be vertically aligned in order to be inserted downwardly into the bottle group. This turning or twisting of the partition has proven to be undesirable for several reasons. Some paperboard materials can be deformed as they are twisted or turned in the apparatus. Further, partitions having score lines which define flaps or wings that are later turned outwardly before the partition's insertion into a bottle group do not work well in an apparatus that turns or twists the partition. In many of these cases, the flaps of the partition are prematurely opened or broken away from the body of the partition in its card form. These flaps can cause a jam in the system and interrupt product flow, causing down time.

In order to effectively handle partitions, especially those which include score lines for flaps or wings, it would be desirable to have a partition selection and delivery apparatus which would select a partition from the supply magazine without opening the flap, and orient the partition vertically throughout its path of travel to the selected location to further ensure against an opening of the flaps.

Another drawback with the previous partition selection and delivery apparatus is that it is limited to only one partition size. The previous apparatuses were rather inflexible in that they could not select partitions having different dimensions, such as widths. Because the selection and delivery apparatuses, and thus the packaging machines, were limited to just one type of partition, the packaging machines were also limited to just one type of product configuration.

SUMMARY OF THE INVENTION

The present invention comprises an article selection and delivery apparatus and method, especially intended to select a single article at a time from a supply magazine, orient the article for delivery without twisting or turning the article, and then deliver the article to a preselected location. The present invention, therefore, accomplishes these functions with a minimal amount of handling and physical degradation of the article. The invention is especially applicable for use in delivering partitions into a bottle group in a high speed, continuous motion packaging machine.

The apparatus includes an article selector for removing a single article from a supply magazine. In the case of planar articles such as partitions, advertisements or informational literature, conventional supply magazines that position the forwardmost article for selection, work satisfactorily with the present invention. In the case of selecting and delivering partitions in a continuous motion packaging machine, the selecting step preferably is accomplished by two vacuum assemblies, one disposed above the other. The vacuum assemblies are vertically arranged in order to contact the first partition of the supply magazine at its upper and lower areas along its front surface. The vacuum assemblies apply suction to and releasably engage the first partition. The assemblies are then biased away from the supply magazine in order to pull the single partition away from the magazine. The next partition in line then moves downwardly to become the first partition held by the magazine.

The partition which has been removed by the selector is pulled away from the magazine, and oriented into a vertical position, without disengagement from the vacuum cups. In this position, the lower vacuum cups release from engagement from the partition, and the upper vacuum cups, while retaining their engagement with the partition, are moved vertically downward to pull or force the partition along a path of travel to a point where it is then engaged by other means that continue its vertical movement downward. The partition is finally moved to a position where it is then inserted into the bottle group at a high speed. It is important to note that during this process, the partition is not twisted by being passed at various angles through drive wheels, which might bend the partition or open the flaps defined by score lines.

The selector, itself, is believed to be unique, and includes a frame which can be pivoted toward and away from the supply magazine. The starting and ending positions of the frame are vertical, and its engaging position is at an acute angle, being biased toward a supply magazine which holds a group of partitions at an acute angle with respect to the vertical position of the selector. The frame provides support for the lower vacuum assembly, and slidably engages an actuator which supports the upper vacuum assembly. The frame and the actuator are driven through their respective ranges of motion by separate and independent drives. The preferred drive mechanism for both the frame and the actuator are rotary cams which define cam tracks along their inner surfaces. The frame includes a cam follower which projects into its associated cam track of the first cam assembly. The actuator similarly includes a second cam follower which projects into the other cam track of the second cam assembly.

In this manner, the pivoting movement of the frame and the actuator are both controlled by the first cam drive assembly, and the sliding movement of the actuator is independently controlled by the second cam drive assembly. This allows the assemblies to move together through one range of pivoting motion by the frame, while thereafter allowing the first or upper vacuum assembly to be vertically moved by the actuator, without moving the second or lower vacuum assembly. The downward movement of the partition by the actuator is in timed relationship with a partition conveyor. The conveyor moves the partition to a point where it is engaged along both surfaces by high speed wheels, which accelerate its motion and shoot it into a bottle group moving laterally below the partition inserter at high speeds.

The article selection and delivery apparatus is also capable of being adjusted for different article widths. The frame of the apparatus is adjustably mounted on a set of bolts extending from either side of the apparatus. The bolts are driven in synchronism with each other and the end of one bolt is connected to a knob. By rotating the knob, the sides of the frame can be moved toward or away from each other in order to adjust the width of the frame to correspond to the width of the particular article being selected. The positions of the vacuum cups on the apparatus are also adjustable so that they may be moved inwardly or outwardly, depending upon the width of the article.

It therefore is an object of the present invention to provide an apparatus for selecting a single, planar article at a time, and orienting the article as needed for delivery to a preselected location. In the case of bottle partitions inserted into a preconfigured product group by packaging machines, it is an object of the present invention to provide an apparatus which will handle the partition in such a way so as not to damage it or open any flap scored into the partition. Also in the case of such partitions, it is an object of the present invention to orient the partitions vertically within the step of selecting the partition from a magazine, so that the partition is ready to be inserted into the product group. The present invention also includes as an object the method of selecting a single article from a supply magazine and delivering the article to the selected location, without adversely affecting the integrity of the article. The present invention accomplishes the above-stated objects by providing for efficient, continuous, high speed delivery of the article to a specified location, and including in timed relationship with other continuous motion high speed operations.

DETAILED DESCRIPTION OF THE PREFERRED EMBODIMENTS

Figure 1:
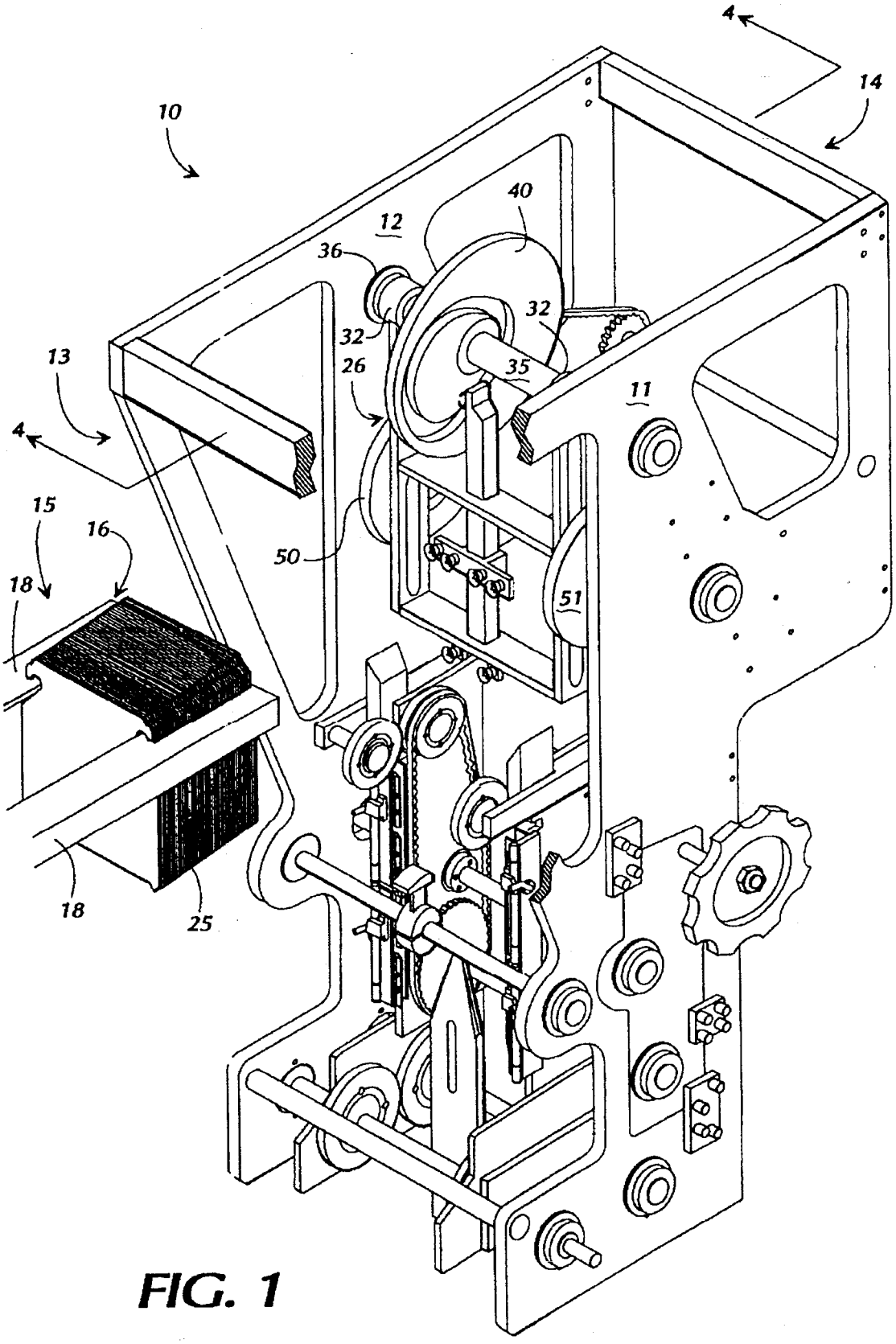
FIG. 1 is a fragmentary, perspective view of the article selector and delivery apparatus of the present invention.

FIG. 1 shows the apparatus 10 for selecting and delivering a planar article. While the present invention discloses a method and apparatus capable of selecting and delivering various types of planar articles, for the purpose of illustrating the present invention, only, the apparatus 10 shown comprises an apparatus for selecting and delivering a partition for use in association with a packaging machine. The apparatus, or partition inserter 10, includes side plates 11 and 12. The side plates preferably are comprised of steel or other suitable, strong material capable of supporting their associated elements. The side plates 11, 12 are substantially flat, upstanding, opposed support members which can include cut out portions for weight reduction.

For the purpose of description, partition inserter 10 includes forward or front end 13 and rearward or back end 14. Partition inserter 10 includes a partition supply magazine 15 having a forward end 16 facing the forward end 13 of the partition inserter. For the purposes of the present invention, the supply magazine 15 can be any type of partition supply magazine capable of holding a supply or stack of planar articles, such as bottle partitions, and positioning or presenting a forward most partition in the stack at a desired location and orientation for selection.

Various types of partition magazines, or collapsed, paperboard carton supply magazines, are known in the packaging machine industry. FIG. 1, however, shows a new type of supply magazine comprised of two spaced parallel bars 18 which support partitions 25. As will be discussed in more detail hereinafter, the partitions 25 have opposed notches formed in their upper edges so that the partitions can be suspended or hung from the support bars 18. The supply magazine preferably is tilted or canted in order to present the forward most partition at an acute angle for selection. The preferred supply magazine and feeder apparatus is described in commonly-assigned U.S. patent application Ser. No. 08/418,100, filed on Apr. 6, 1995 entitled "Mass Feeder For Product Delivery System."

The opposed side plates or frames of the partition inserter assembly 10 support a partition selector 26 substantially at their upper end portions as shown in FIG. 1. The partition selector is designed to select or remove a single partition at a time from the supply magazine, and return the selected partition to a point for further processing. In doing so, the selector 26 also places the partition in a position where it can be conveyed through the inserter 10 for a timed delivery to a specified location. In the case of the present invention, the partition selector 26 is oriented vertically; however, in other applications, the partition selector could be oriented at an angle for delivery of an article to a specified location.

The partition selector 26 includes frame 27. Frame 27 includes upstanding spaced side bars 28 and 29, central crossbar 30, and lower crossbar 31. Side frames 28 and 29 include annular brackets 32 integrally formed in their upper ends.

Figure 2:
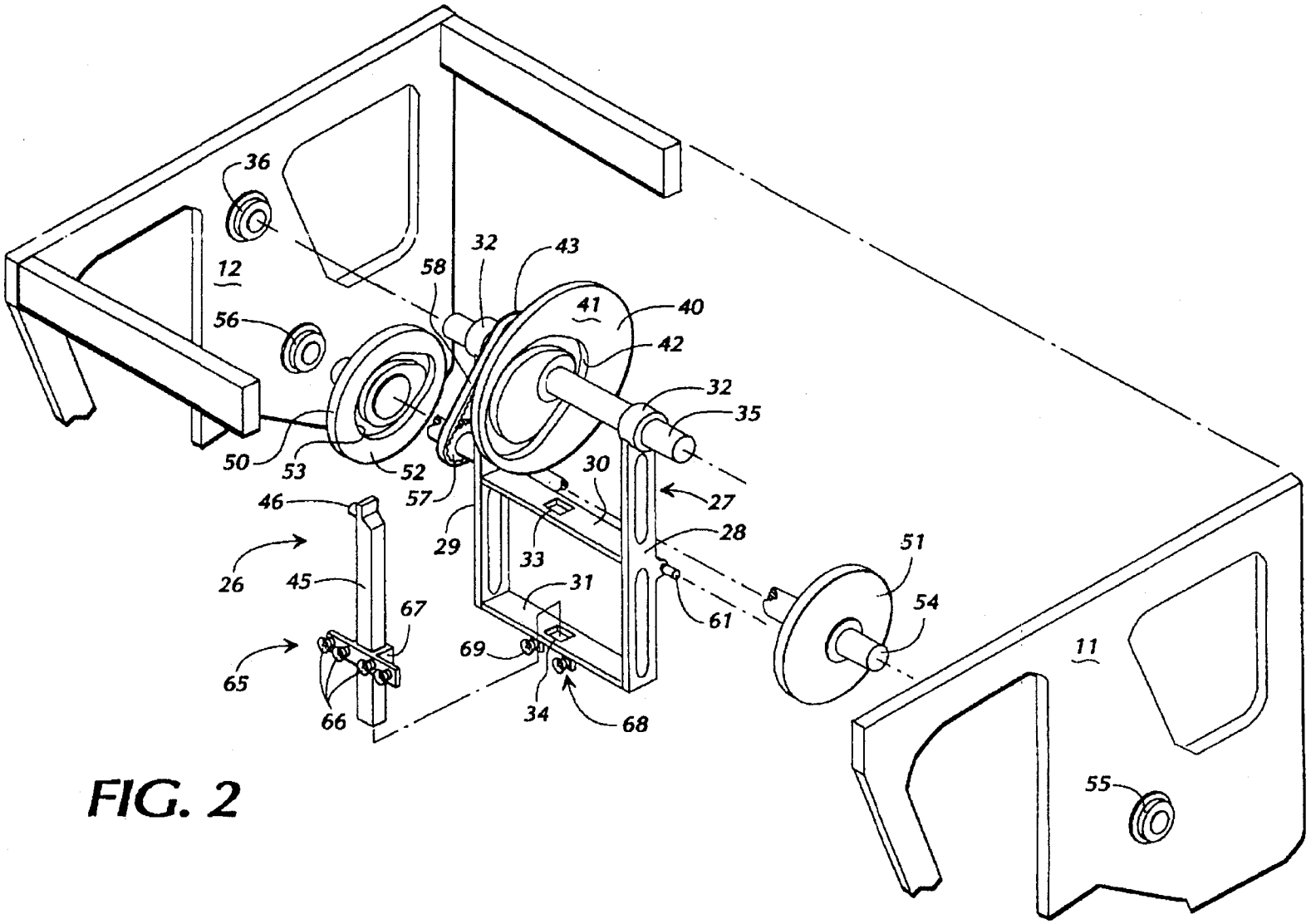
FIG. 2 is an exploded perspective view of the selector cam drive mechanisms shown in FIG. 1.
Figure 3:
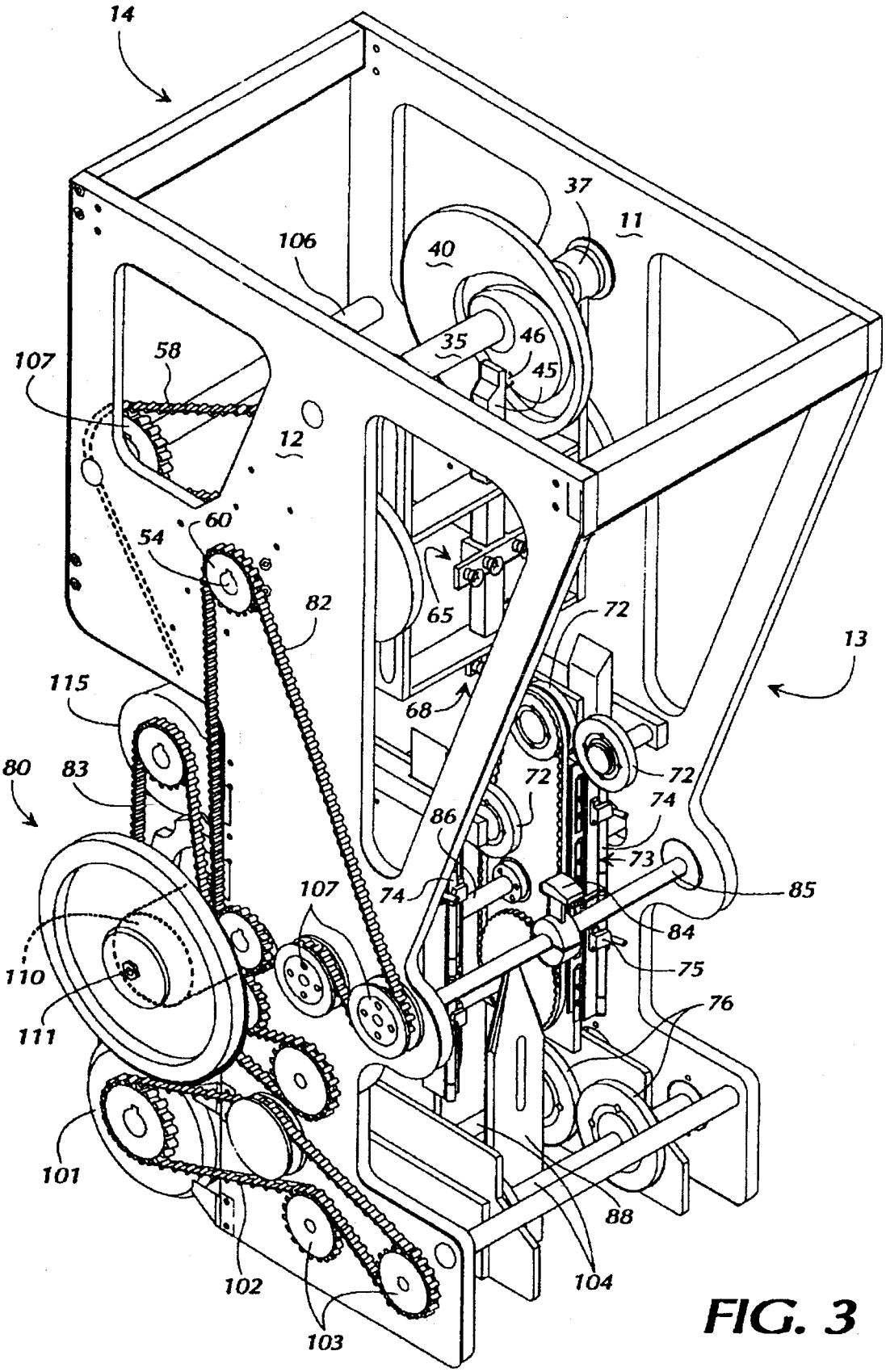
FIG. 3 is a fragmentary, perspective view of the apparatus of FIG. 1, shown from a front view opposite that shown in FIG. 1.

Crossbar 30 defines central opening 33 therethrough. Lower crossbar 31 also defines a central opening 34. Central opening 34 is vertically aligned with central opening 33. A transverse shaft 35 extends laterally from side plate 12 to side plate 11. Shaft 35 is journaled at one end in bearing 36 attached to the inner surface of side plate 12, as shown in FIG. 2, and at its other end in bearing 37, centrally attached to the inner surface of side plate 11, as shown in FIG. 3. Transverse shaft 35 runs through each annular bracket 32 of frame 27, so that frame 27 is suspended from shaft or rod 35. The annular brackets 32 are not attached to shaft 35. The shaft 35 turns freely within brackets 32 without imparting movement to frame 27. Frame 27 is suspended on shaft 35 so that each bracket 32 is approximately equidistant from the midpoint of shaft 35.

A cam 40 is mounted to shaft 35 between annular brackets 32 as shown in FIG. 2, so that cam 40 turns or is driven by shaft 35. Cam 40 defines along the inner surface 41 a cam track 42. Also mounted to shaft 35 between side plate 12 and annular bracket 32 as shown in FIG. 2 is a pulley or drive sprocket 43.

An actuator 45 comprising an elongate, vertically extending square steel rod is received in openings 33 and 34 so that actuator 45 is slidably engaged with crossbars 30 and 31 at frame 27. A cam follower 46 extends from the upper end of actuator 45 to be received within cam track 42 when actuator 45 is itself received within openings 33 and 34. The rotational movement of cam 41 and the selected shape of cam track 42 therefore control the slidable movement of actuator 45 within openings 33 and 34. Cam track 42 of the present invention is shaped so that the rotation of cam 40 will cause the actuator to slide up and down within opening 33 of crossbar 30 and opening 34 of crossbar 31 when frame 27 is oriented vertically, as discussed hereinafter. It should be clearly understood, therefore, that movement of upper cam 40 selectively controls the vertical movement of actuator 45.

Similarly, a pair of identical, opposed cams 50 and 51 control the horizontal movement of frame 27. Defined in the inner surface 52 of cam 50 is cam track 53, and defined within the inner surface (not shown) of cam 51 is another cam track (not shown). The cam tracks of cams 50 and 51 are mirror images of one another when cams 50 and 51 are in their desired positions. Cams 50 and 51 are mounted to drive shaft 54 which, itself, is journaled by brackets 55 and 56 of side plates 11 and 12, respectively. The rotation of drive shaft 54, therefore, drives and rotates cams 50 and 51 therewith.

Adjacent to cam 50 as shown in FIG. 2, and also mounted to drive shaft 54 to rotate therewith is drive sprocket 57. Drive sprocket 57 is attached at the same transverse position on shaft 54 as is pulley 43 on shaft 35. A drive belt 58 extends along drive sprocket 57 and pulley 43 so that the rotational movement of shaft 54 causes an identical rotational movement of shaft 35. Shaft 54 extends through bracket 56 and side plate 12, and supports drive sprockets 60 on the outer side of plate 12 as shown in FIG. 3. Drive sprocket 60 is mounted to and keyed with drive shaft 54, so that as sprocket 60 is rotated, shaft 54 and shaft 35 are rotated therewith through the cooperation of sprocket 57, pulley 43, and belt 58. The cooperating drive mechanisms for the various components of the present invention will be discussed further hereinafter.

Frame 27 supports transversely extending cam followers 61 and 62. Cam follower 61 is received within the cam track (not shown) of cam 51, while cam follower 62 is received within cam track 53 of cam 50. The rotation of drive shaft 54, therefore, causes cams 50 and 51 to rotate, which, in turn, moves frame 27 in a pivoting motion about shaft 35 by the cooperation of cam followers 61 and 62 in the cam tracks of cams 51 and 50, respectively.

A first vacuum assembly 65 is attached to actuator 45 in slidable engagement. Vacuum assembly 65 includes a series of vacuum cups 66 mounted to a support frame 67. Support frame 67 can be selectively positioned along most of the length of actuator 45 depending upon the size and shape of the article to be selected. Vacuum assembly 65 also includes vacuum supply means (not shown) including vacuum lines, a suitable vacuum source, and valves. These elements are well known in the art and therefore not further described herein. A second vacuum assembly 68 is affixed to the lower crossbar 31 of frame 27 to pivot therewith. Second vacuum assembly 68 includes two spaced cups 69 and, similar to first vacuum assembly 65, includes suitable vacuum lines, vacuum supply source, and valves (not shown).

First vacuum assembly 65, therefore, moves toward and away from upper crossbar 30 and lower crossbar 31 along with the movement of actuator 45 through openings 33 and 34. Conversely, lower vacuum assembly 68 moves only in the rotational path of pivotal movement about shaft 35 along with lower crossbar 31 of frame 27. These elements cooperate to become attached to the partition 25 from the supply magazine 15 and to move the partition away from the supply magazine while orienting it vertically. The elements then deliver the partition to a selected location immediately below the partition inserter 10.

Figure 4:
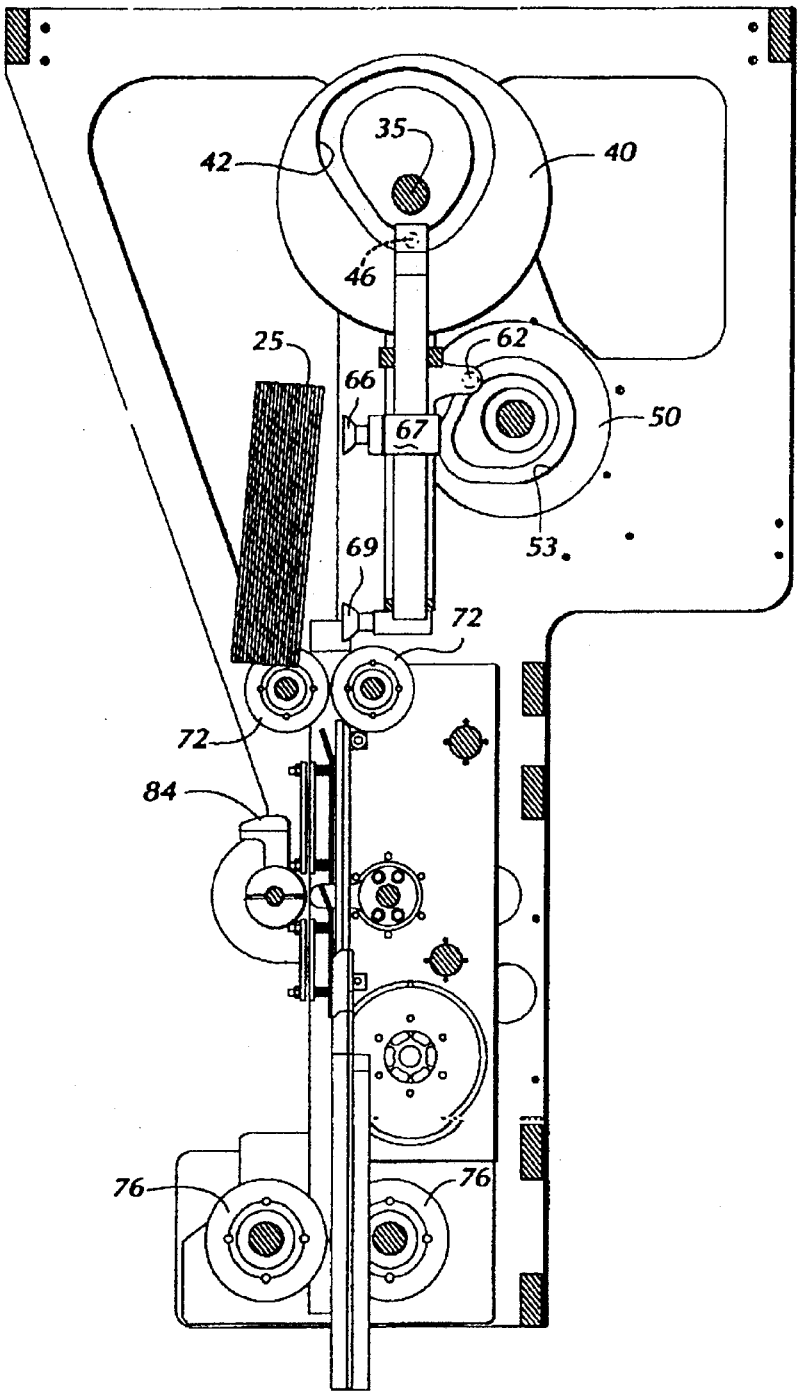
FIG. 4 is a cross-sectional view, taken along lines 4—4 of FIG. 1.
Figure 5:
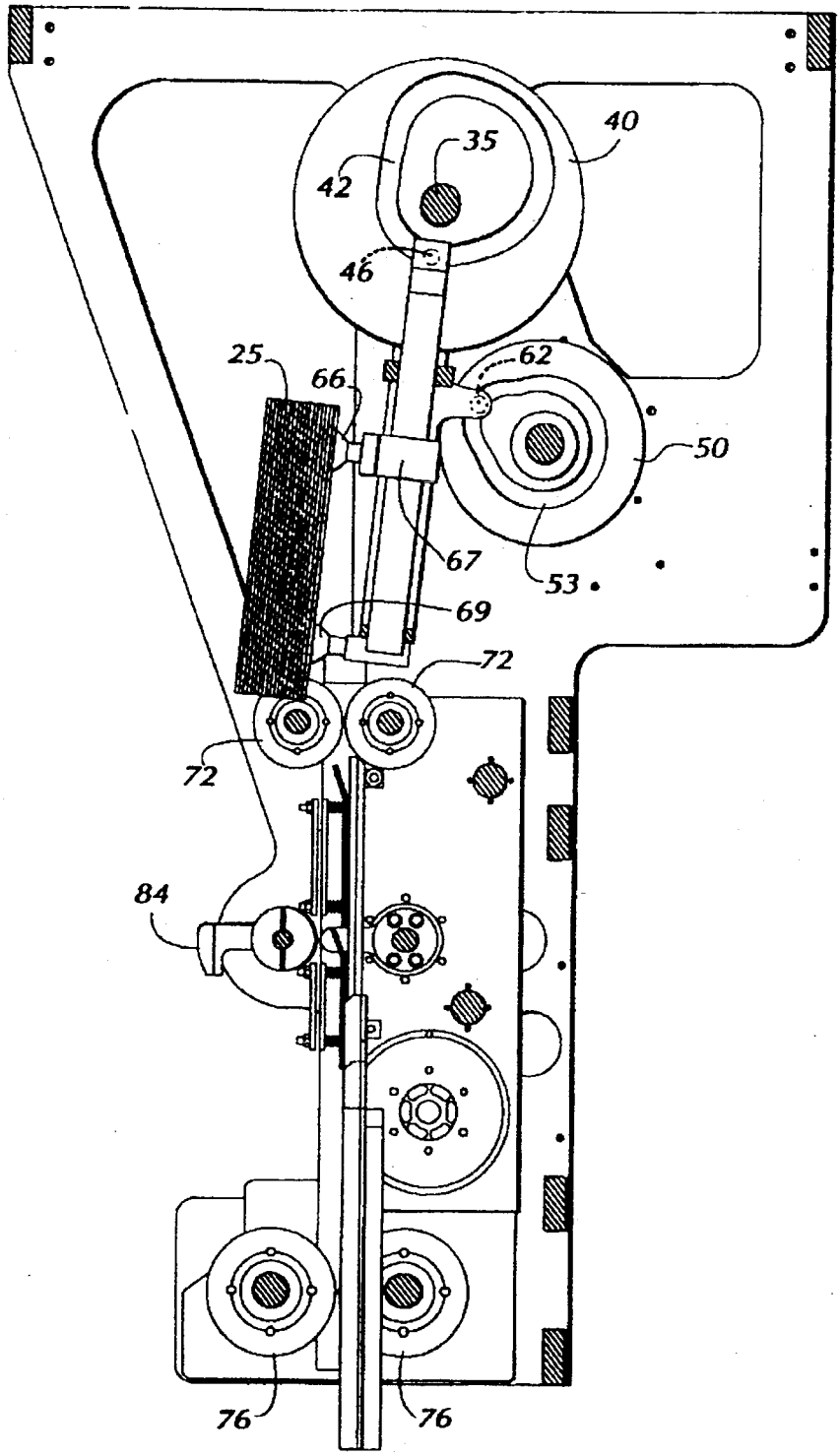
FIG. 5 is another cross-sectional view as shown in FIG. 4, but with the selector pivoted to engage an article.
Figure 6:
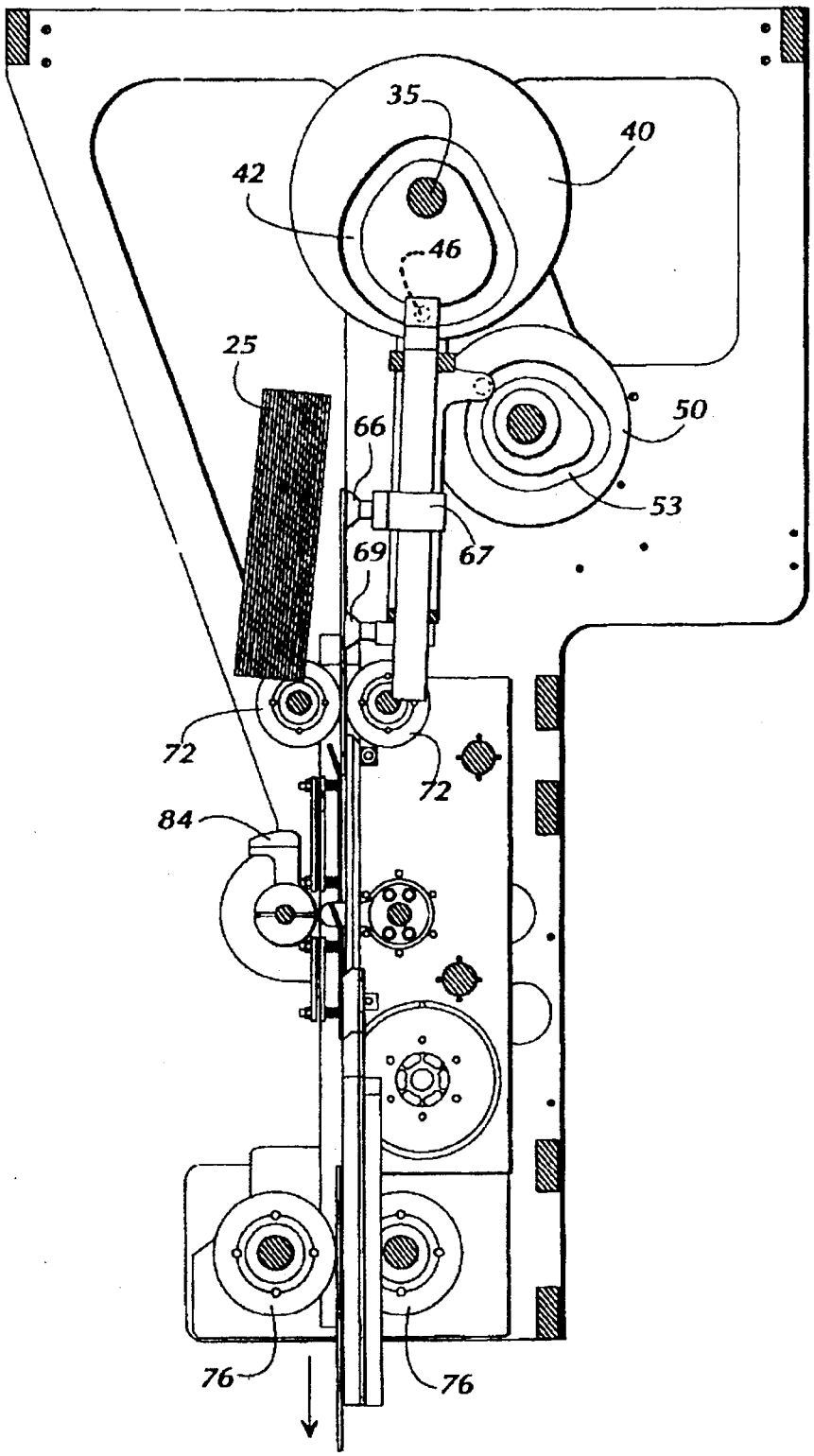
FIG. 6 is another cross-sectional view as shown in FIG. 4, but with the selector placing the article to be engaged by the delivery mechanism.

The partition inserter 10 also includes elements to convey the partition away from partition selector 26 and toward the selected location below the partition inserter 10. These elements are well known in the art, but will be described generally as background information for understanding the operation of the present invention. Disposed immediately below selector 26 are four friction wheels 72, with each pair of the opposed friction wheels 72 being mounted to plate 11 and plate 12, respectively. The friction wheels are positioned so that the tangent points between pairs of opposed wheels 72 are immediately below an imaginary line extending from the surface of upper cups 66 to lower cups 69 as shown in FIG. 4. These pairs of friction wheels 72 turn inwardly toward one another, so as to grab the partition and move it downwardly away from selector 26.

A conveyor 73 comprised of two, spaced, vertically oriented belts 74 having outwardly extending flights 75, is mounted below friction wheels 72 and moves downwardly in timed relationship with the downward movement of actuator 45 so that a partition is placed between successive flights 75. In this manner, the partition is conveyed downwardly at a controlled rate toward the selected area below partition inserter 10.

A knocker bar 84, which rotates about knocker shaft 85, contacts the partition 25 as the partition 25 moves down toward the bottom of the partition inserter 10. A second knocker 84 (not shown) rotates about knocker shaft 86 and contacts the opposite side of the partition 25. The knocker bars 84 have an enlarged head which are moved completely through the planar surface of the partition 25 to thereby knock out the flaps or wings of the partition. After the flaps or wings have been slightly separated by the knocker bars 84, a camming wedge 88 contacts the flaps or wings and moves the flaps or wings into their fully extended position. The preferred partition 25 has knock out portions which form two transverse side walls and is intended to be used with products arranged in two rows and three columns.

After the flaps or wings have been fully extended by the camming wedge 88, the partition is then grabbed by a second set of opposed friction wheels or shooter wheels 76 mounted adjacent to both plates 11 and 12, respectively. Shooter wheels 76 not only pull the partition away from conveyor 73, but accelerate the downward movement of the partition substantially, so that the partition is fired into the selected area at a specific point in time, and in timed relationship with the lateral movement of a bottle group below partition inserter 10. Friction wheels 72, conveyor 73, and shooter wheels 76 are well known in the art, and are used on known partition inserting devices.

The speed at which the shooter wheels 76 rotate is adjustable. As best seen in FIG. 3, the shooter wheels 76 are mounted on shafts 104 having drive sprockets 103 at one end of the shafts 104. An output of a synchronous motor 101 drives a belt 102 which is looped partially around the sprockets 103. The speed of the synchronous motor 101 therefore directly controls the speed of the shooter wheels 76 and the speed at which the partitions 25 leave the partition inserter 10.

The shooter wheels 76 are preferably operated at about 1400 RPM. At such a speed, a partition 25 is ejected from the shooter wheels 76 and is placed in position within a bottle group in about 0.03 seconds for a 9 inch bottle. This high speed at which the partitions 25 are released from the partition inserter 10 can sometimes cause the partitions 25 to bounce upwardly from a conveyor moving the bottles, and to move back toward the partition inserter 10. The partitions 25 that have extended flaps or wings typically do not bounce out of position to any great extent, since the wings or flaps contact adjacent products and limit the upward travel of the partitions 25. Conversely, the partitions 25 that do not have wings or flaps, or simply cards, undergo a greater amount of upward travel after contacting the product conveyor, and are more frequently moved out of position.

The speed at which the shooter wheels 76 operate may be lowered, even during a cycle of shooting a partition, in order to reduce the kinetic energy imparted to the partitions 25 as they leave the shooter wheels 76. For instance, for the partitions 25 without any flaps or wings, the shooter wheels 76 are preferably operated at about 600 RPM. The speed of the shooter wheels 76 may also be lowered during only a fraction of its revolution. For instance, the shooter wheels 76 may be operating at a first speed when the shooter wheels 76 begin moving the partition 25 down toward the product group. At a certain point in the partition's 25 travel through the shooter wheels 76, the speed of the shooter wheels 76 is reduced to a second lower speed. By reducing the speed of the shooter wheels 76, the kinetic energy of the partitions 25 and the amount of bounce is reduced. This dual speed of wheels 76 during a cycle also can be effectively used for the insertion of a partition having flaps, if this bouncing phenomenon is a problem.

The partition inserter 10 may additionally include a set of opposed, inwardly protruding brushes and biasing members for slowing the partitions' downward movement and for maintaining the partitions 25 in position after bouncing off of the product conveyor. For instance, a set of opposed brushes preferably are placed beneath the shooter wheels 76, with a point of contact between the outer ends of the brushes being aligned with the downward path of travel of the partitions 25. The biasing members may comprise pieces of sheet metal having hooked ends that extend or curve outwardly toward an adjacent pair of separated bottles.

When the partitions 25 leave the shooter wheels 76, the speed of the partitions 25 is reduced as the partitions 25 travel down past the brushes, thereby reducing the kinetic energy of the partitions 25. After the partitions 25 contact the product conveyor and begin to travel back toward the partition inserter 10, the partitions 25 collide with the bottom of the brushes or the biasing members, which halt the upward movement of the partitions 25. Thus, with the brushes and biasing members, the partitions 25 remain in position within a bottle group.

A servo-motor 110 is used to drive the remaining elements of the partition inserter 10. More precisely, an output of the servo-motor 110 rotates a belt 83 looped around an input of a gear reduction box 115. The output of the box 115 drives the belt 58 which loops partially around a sprocket 107 on shaft 106 and around the pulley 43 on shaft 35. The output of the gear box 115 therefore rotates the cam 40 controlling the vertical positioning of the vacuum cups 66 and 69. The belt 58 also controls the rotation of the shaft 54 having the cams 50 and 51. As shown in FIG. 3, an end of the shaft 54 has the sprocket 60 engaged with the belt 82. The belt 82, in turn, is looped around drive sprockets 107 for rotating the knocker shafts 85 and 86 and knockers 84.

The belt 58 is also used to control other elements of the partition inserter 10 which are not shown in order to simplify the drawings and the description of the invention. For instance, the belt 58 times the supply of vacuum to the cups 66 and 69 with the rotation of the cams 40, 50, and 51. The belt 58 also controls the timing of the conveyor 73 and friction wheels 72. The manner in which the other elements of the partition inserter 10 are controlled will be apparent to one skilled in the art and accordingly will not be discussed in further detail.

The speed of the servo-motor 110 is tied by computer control to the speed of the product conveyor, so that the partitions 25 are placed at the proper position within a product group regardless of the speed at which the packaging machine is operating or moving product groups laterally below the partition inserter. The coordinated control of the servo-motor 110 and the conveyor for the products will be apparent to one skilled in the art and will not be discussed in further detail. Thus, with the servo-motor 110 being controlled according to the speed of the product conveyor, the speed of the product conveyor can be increased or decreased and the partition inserter 10 will adjust its speed to correspond to that of the product conveyor, whereby partitions 25 will be consistently placed in the proper positions within the product groups.

In the embodiment shown, the servo-motor 110 controls the rate at which the partitions 25 are selected and the speed at which the partitions 25 are lowered until the partitions 25 contact the shooter wheels 76. The shooter wheels 76 are independently controlled by the adjustable speed synchronous motor 101, and preferably are set as high as possible so that the placement of the partitions 25 is approximately instantaneous. The total time of delivery for a partition 25 from the supply magazine, therefore, is dependent upon the speed of the servo-motor 110 and the speed of the shooter wheels 76.

The timing of the partition inserter 10 is matched to the product conveyor by first selecting the highest speed of the shooter wheels 76 at which the amount of bounce for the partitions 25 is acceptable. Next, the servo-motor 110 is adjusted so that a partition 25 is delivered in synchronism with a bottle group on the product conveyor. The speed of the product conveyor is then changed as desired, and the setting of the servo-motor 110 is determined for this second speed. With the two settings of the servo-motor 110 for the two speeds of the product conveyor, a linear relationship can be determined between the speed of the servo-motor 110 and the speed of the product conveyor. Based on this linear relationship, the speed of the servo-motor 110, and thus of the entire partition inserter 10, can accurately track the speed of the product conveyor so that the partitions 25 are consistently placed within the product groups.

In operation, a supply magazine, such as magazine 15, is disposed so that its forward end 16 is immediately adjacent to selector 26 at the forward end 13 of the partition inserter 10. The drive mechanism 80 having drive belt 82 drives sprocket 60 with turn shaft 54. The movement of drive shaft 54 rotates drive cams 50 and 51, the mirror image cam tracks of which are set to drive cam follower 61 forward and toward partition supply magazine 15. This movement pivots frame 27 about the shaft 35 so that both vacuum assembly 65 and vacuum assembly 68 are also pivoted or moved toward the supply magazine 15. When the vacuum assemblies 65 and 68 come in contact with the forward most partition 25 supported by supply magazine 15, the vacuum supply assemblies (not shown) are activated to supply a vacuum both to assembly 65 and to assembly 68. This causes the forward most partition 25 to be releasably attached to the vacuum assemblies 65 and 68.

The continued rotation of shaft 54 and cams 50 and 51 cause their associated cam tracks to continue rotating and move cam followers 51 and 52 away from the supply magazine. This pulls frame 27 away from the supply magazine, towards it starting, vertical position. Since partition 25 is attached to vacuum cups 66 and 69, the forward most partition, only, is pulled from the supply magazine 15, which allows the remaining partitions in the supply magazine 15 to move forwardly. While the cams 50 and 51 are pivoting the vacuum assemblies 65 and 68, the cam follower 46 is in a dwell portion of its travel.

When the frame 27 is pivoted back to its original vertical position, the vacuum supply mechanism (not shown) for the lower vacuum assembly 68 shuts off, releasing the engagement of vacuum cups 69 to the lower portion of partition 25. At the point where the partition is vertically positioned, cam followers 61 and 62 begin entering the dwell portions of the respective cam tracks of cams 50 and 51, so that frame 27 remains in the vertical position until after partition 25 is completely released and carried downwardly by conveyor 73.

With the partition being vertical, cam follower 46 enters the portion of cam track 42 which drives cam follower 46 and actuator 45 downwardly. Since the vacuum supply means (not shown) for upper vacuum assembly 65 is still operable and applying vacuum to cups 66, upper vacuum assembly 65 at this point still is attached to the upper portion of partition 25. The downward movement of actuator 45 therefore causes the partition 25 to be moved vertically downward until partition 25 is engaged by upper friction wheels 72. When the partition reaches the friction wheels 72, the vacuum source for upper vacuum assembly 65 is shut off, thereby releasing partition 25 from both vacuum assemblies 65 and 68 of selector 26.

The partition 25 is not only selected from the supply magazine 15 but is oriented vertically and delivered to elements which move it away from the selector 26 toward the desired location. The invention, as in the prior art, have friction wheels 72 for pulling the partition downwardly until the partition is engaged by conveyor 73.

The movement of conveyor 73 is timed so that the partition is delivered between the outwardly extending flights 75. The partition 25 is then moved downwardly until it is engaged by accelerating shooter wheels 76, where it is then accelerated and delivered to the selected location, which is that point immediately below the tangent line between opposed shooter wheels 76, as shown in FIG. 3.

Immediately after the top edge of the partition is moved below lower vacuum assembly 68, the selector process begins again, with the frame being pivoted toward the supply magazine to engage the next, forward most partition 25. It is thus clear that the process is continuous, with the partition inserter 10 being operable at high speeds to deliver, for example, up to about 300 partitions per minute to the selected location, in timed relationship with the passing of a bottle group transversely below the partition inserter.

Figure 7:
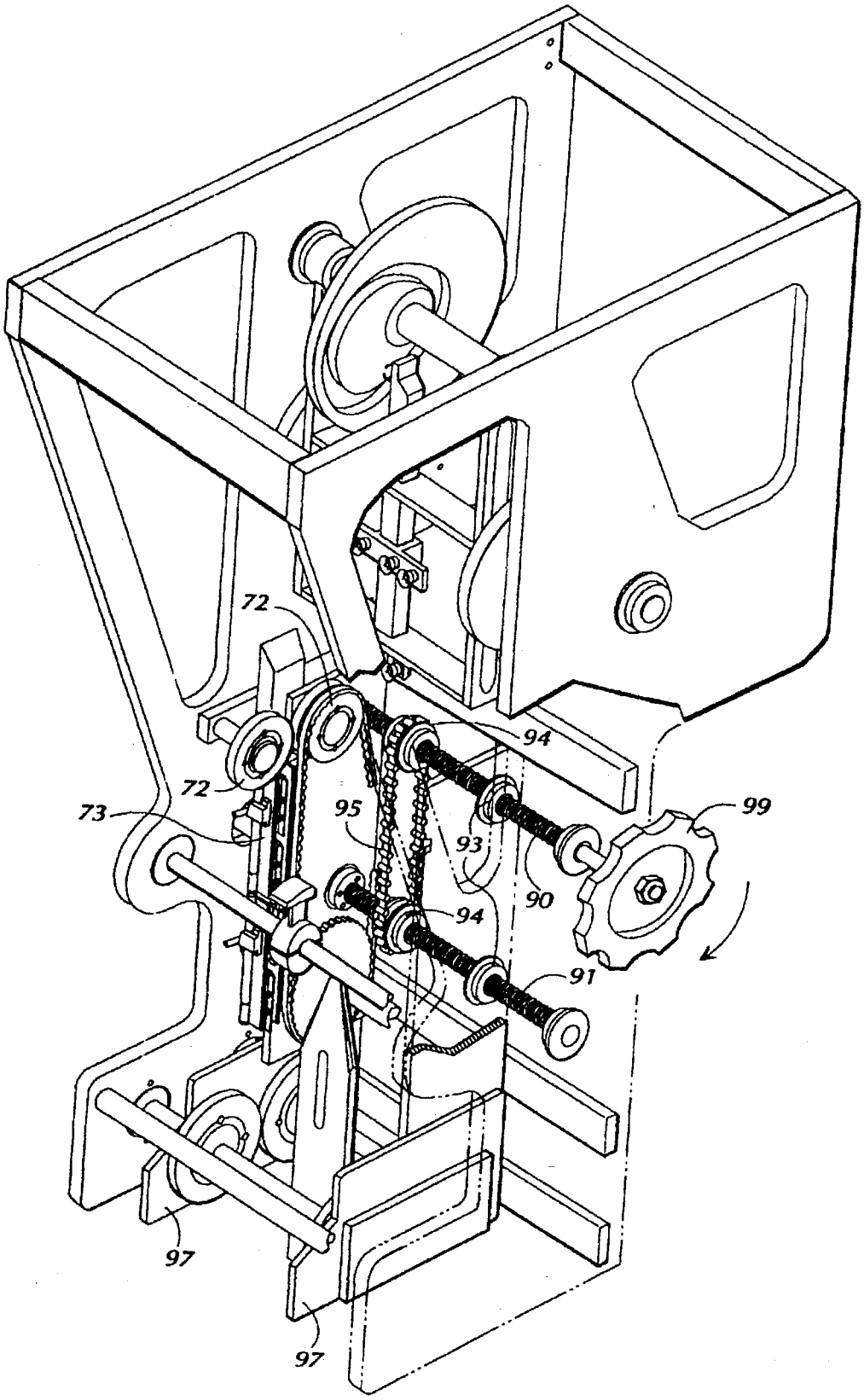
FIG. 7 is a fragmentary, perspective view of the apparatus of FIG. 1, showing the lateral adjustment mechanism for enabling the apparatus to select and deliver different sized articles.

With reference to FIG. 7, the partition inserter 10 is capable of being adjusted to receive partitions 25 of varying widths. The partition inserter 10 has a pair of spaced walls 97 having nuts 93 integrally mounted to the walls 97 with the nuts 93 being threaded onto an upper bolt 90 and a lower bolt 91. Pulleys 94 on the upper 90 and lower 91 bolts are aligned with each other and are joined together with a belt 95. Since the bolts 90 and 91 are coupled together, both of the bolts 90 and 91 are rotated when a knob 99 connected to an end of bolt 90 is rotated. The opposite ends of the bolts 90 and 91 are threaded in opposite directions so that the plates 97 will move in opposite directions upon rotation of the knob 99. Because the conveyors 73 and friction wheels 72 are mounted to the plates 97, the distance between the conveyors 73 and the friction wheels 72 can be adjusted to correspond to the width of the partitions 25.

It will be further obvious to those skilled in the art that many variations may be made in the above embodiments here chosen for the purpose of illustrating the present invention, and full result may be had to the doctrine of equivalents without departing from the scope of the present invention, as defined by the appended claims.

What is claimed is:

1. An apparatus for selecting a planar article having a first side and a second side from a group of planar articles and delivering the planar article to a selected location, comprising:

means for selecting the planar article from said group, said selecting means comprising a first vacuum assembly, a second vacuum assembly, and first means for moving said first vacuum assembly and said second vacuum assembly in a first direction into engagement with said planar article;

said first means for moving operatively attached to said first vacuum assembly and said second vacuum assembly so that said first and second vacuum assemblies are activated after said first and second vacuum assemblies engage said planar article;

said first moving means also for moving said first and second vacuum assemblies away from said group of planar articles after said first and second vacuum assemblies have engaged said planar article, whereby said planar article is removed from said group;

means for deactivating said second vacuum assembly after said planar article has been removed from said group; and second means for moving said first vacuum assembly and not said second vacuum assembly in a second direction toward the selected location, said second means for moving operatively attached to said first vacuum assembly so that said first vacuum assembly is deactivated after said planar article has been moved in said second direction.

2. The apparatus of claim 1, further comprising means for delivering said planar article away from said first vacuum assembly to said selected location, said means for delivering disposed adjacent to said second vacuum assembly.

3. The apparatus of claim 2, said means for delivering including first friction wheels disposed below said second vacuum assembly, an article conveyor disposed below said first friction wheels, and second friction wheels disposed below said article conveyor.

4. The apparatus of claim 1, said first vacuum assembly comprising a first vacuum cup, and first vacuum supply means attached to said first vacuum cup for pulling a vacuum.

5. The apparatus of claim 4, said first vacuum assembly including a second vacuum cup spaced from said first vacuum cup.

6. The apparatus of claim 1, said first means for moving said first vacuum assembly and said second vacuum assembly comprising a frame, and first means operatively connected to said frame for biasing said frame toward and away from said planar article.

7. The apparatus of claim 6, said second means for moving said first vacuum assembly toward said selected location is slidably engaged by said frame.

8. The apparatus of claim 7, and second means for biasing said first vacuum assembly toward said selected location, comprising a second cam disposed adjacent said frame, said second cam defining a second cam track, and said second means for moving said first vacuum assembly including a second cam follower disposed within said second cam track.

9. The apparatus of claim 1, wherein said second direction is generally orthogonal to said first direction.

10. An apparatus for selecting a planar article having a first side and a second side from a group of planar articles, and delivering the planar article to a selected location, comprising:

(a) means for positioning the planar article for selection;

(b) means for selecting the planar article, said means for selecting disposed adjacent to said means for positioning the planar article, and comprising a first vacuum assembly, and a second vacuum assembly disposed below said first vacuum assembly, and first means for moving said first vacuum assembly and said second vacuum assembly into engagement with said planar article, said first means for moving, operatively attached to said first vacuum assembly and said second vacuum assembly; and (c) second means for moving said first vacuum assembly toward the selected location, said second means for moving operatively attached to said first vacuum assembly;

said first means for moving said first vacuum assembly and said second vacuum assembly comprising a frame, and first means operatively connected to said frame for biasing said frame toward and away from said planar article;

said first means for biasing including a first cam disposed adjacent to said frame, said cam defining a first cam track, and said frame including a first cam follower disposed within said first cam track.

11. A selecting apparatus for removing a single article from a stack of articles and for placing the single article at a selected position within a group of products as the products are moved downstream by a product conveyor, comprising:

means for removing said single article from said stack of articles;

means for moving said single article in a downward direction toward said product conveyor and for placing said single article at said selected position within said group of products; and means for adjusting a rate at which said removing means removes each article from said stack of articles and a speed at which said single article is moved downward toward said product conveyor to correspond to a speed of said product conveyor, whereby each article is consistently placed at said selected position within said group of products regardless of said speed of said product conveyor.

12. The apparatus as set forth in claim 11, wherein said removing means comprises a frame and a set of vacuum cups mounted to said frame, said frame moving toward said stack of articles to engage said vacuum cups with said single article and said frame moving away from said stack to remove said single article from said stack.

13. The apparatus as set forth in claim 11, wherein said moving means comprises an article conveyor belt for guiding said article down toward said product conveyor.

14. The apparatus of claim 11, wherein said moving means comprises a set of shooter wheels for placing said single article at said selected position and said adjusting means comprises a synchronous motor for adjusting a speed at which said shooter wheels are rotated.

15. The apparatus of claim 11, wherein said rate at which said removing means removes each article is synchronized to said speed at which said single article is moved downward by said moving means.

16. The apparatus of claim 11, wherein said adjusting means comprises a servo-motor for determining said rate at which said removing means removes each article and also for determining said speed at which said single article is moved downward by said moving means.

17. A selecting apparatus for removing a single article from a stack of articles, comprising:

a first shaft;

a second shaft mounted parallel to said first shaft;

means for rotating said second shaft about a longitudinal axis of said second shaft;

a first cam mounted to said second shaft and having a first cam track;

a frame pivotally mounted to said first shaft and having a first cam followers engaging said first cam track; and a first vacuum cup mounted to said frame;

wherein said first cam track is defined to pivot said frame outward toward said stack of articles for engaging said single article with said first vacuum cup and to pivot said frame back away from said stack of articles to remove said single article from said stack of articles.

18. The selecting apparatus as set forth in claim 17, further comprising:

a second cam mounted to said first shaft and having a second cam track;

means for rotating said first shaft;

a vertical member adjustably mounted to said frame and having a second cam follower engaging said second cam track; and a second vacuum cup mounted to said vertical member;

wherein said second cam track is defined to lower said vertical member and said second vacuum cup so that said single article is lowered after said single article has been removed from said stack of articles.

19. The selecting apparatus as set forth in claim 18, wherein said vertical member extends through an aperture in said frame.

20. The selecting apparatus as set forth in claim 18, wherein said means for rotating said first shaft is said means for rotating said second shaft.

21. The selecting apparatus as set forth in claim 18, wherein said first vacuum cup releases said single article prior to said single article being lowered by said second vacuum cup.

22. An adjustable selecting apparatus for removing a single article from a stack of articles and for placing said single article at a selected position within a group of products, comprising:

means for removing said single article from said stack of articles;

means for moving said single article in a downward direction and for placing said single article at said selected position within said group of products, said moving means comprising a pair of conveyors located on either side of said single article for guiding said single article in said downward direction; and means for adjusting a distance between said conveyors;

wherein activation of said adjusting means varies a distance between said conveyors whereby said moving means can guide articles of varying widths in said downward direction and place said articles of varying widths at the selected position within said group of products;

wherein said removing means comprises a plurality of vacuum cups with a position of at least one of said vacuum cups being adjustable to accommodate another single article of a second width.

23. An adjustable selecting apparatus for removing a single article from a stack of articles and for placing said single article at a selected position within a group of products, comprising:

means for removing said single article from said stack of articles;

means for moving said single article in a downward direction and for placing said single article at said selected position within said group of products, said moving means comprising a pair of conveyors located on either side of said single article for guiding said single article in said downward direction; and means for adjusting a distance between said conveyors;

wherein activation of said adjusting means varies a distance between said conveyors whereby said moving means can guide articles of varying widths in said downward direction and place said articles of varying widths at the selected position within said group of products.

24. The adjustable selecting apparatus as set forth in claim 23, wherein said adjusting means comprises:

a bolt having one end threaded in an opposite direction as an opposite end;

a knob attached to said one end of said bolt;

a pair of mounting plates with each mounting plate having a nut for attaching said mounting plates to opposite ends of said bolt, said conveyors being respectively attached to said mounting plates;

wherein a rotation of said knob causes said mounting plates to move in opposite directions so that distance between conveyors can be adjusted to correspond to said width of said single article.

* * * * *